US006945339B2

(12) United States Patent
Hiranuma et al.

(10) Patent No.: US 6,945,339 B2
(45) Date of Patent: Sep. 20, 2005

(54) CORE DRILL

(75) Inventors: Toshio Hiranuma, Tokyo (JP); Masakazu Ishizeki, Tokyo (JP); Tomohiro Koshiba, Tokyo (JP); Kouichi Tsutsumi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/499,041

(22) PCT Filed: Jan. 14, 2003

(86) PCT No.: PCT/JP03/00214

§ 371 (c)(1),
(2), (4) Date: Jun. 17, 2004

(87) PCT Pub. No.: WO03/061887

PCT Pub. Date: Jul. 31, 2003

(65) Prior Publication Data

US 2005/0016775 A1 Jan. 27, 2005

(30) Foreign Application Priority Data

Jan. 18, 2002 (JP) ..... 2002-010740
Oct. 22, 2002 (JP) ..... 2002-306664
Jan. 9, 2003 (JP) ..... 2003-003646

(51) Int. Cl.[7] ..... E21B 10/02
(52) U.S. Cl. ..... 175/402; 175/394; 175/403
(58) Field of Search ..... 408/229, 230, 408/204; 175/402, 403, 394

(56) References Cited

U.S. PATENT DOCUMENTS 831,056 A * 9/1906 Gilmore ..... 175/333
1,283,662 A * 11/1918 Carmichael ..... 175/205
1,343,902 A * 6/1920 Chapman ..... 175/380
1,572,386 A * 2/1926 Gates ..... 175/379
4,953,642 A * 9/1990 Skaggs ..... 175/393
5,281,060 A * 1/1994 Strange et al. ..... 408/204
5,676,501 A * 10/1997 Peetz et al. ..... 408/204

FOREIGN PATENT DOCUMENTS

| | | |
|---|---|---|
| JP | 50-77991 A | 6/1975 |
| JP | 60-178514 U | 11/1985 |
| JP | 63-110310 U | 7/1988 |
| JP | 64-50910 U | 3/1989 |
| JP | 4-105810 A | 4/1992 |
| JP | 4-325207 A | 11/1992 |
| JP | 10-328918 A | 12/1998 |
| JP | 2001-121332 A | 5/2001 |

* cited by examiner

*Primary Examiner*—Hoang Dang
(74) *Attorney, Agent, or Firm*—Morgan, Lewis & Bockius LLP

(57) ABSTRACT

A plurality of chip evacuating grooves (16, 26, 36, 46*a*, 46*b*) in a vertical direction in parallel with a rotational axis of a core main body (14) are formed at an outer peripheral face of the core main body (14) in a circumferential direction from a lower end portion to an upper end portion of the core main body (14) in a cylindrical shape provided with a drilling blade (15) at a lower end edge thereof. Further, a sectional area of the chip evacuating groove (16) is formed to gradually increase from a lower end to an upper end of the core main body (14). Further, a number of projections (52, 62, 70, 72) are formed at the outer peripheral face of the core main body (14) between the chip evacuating grooves.

16 Claims, 12 Drawing Sheets

CORE DRILL

TECHNICAL FIELD

The present invention relates to a core drill for concrete for boring a comparatively large through hole for piping to concrete, a stone material or the like constituting a wall or a foundation of a building or the like.

BACKGROUND ART

A core drill has conventionally been used for boring a comparatively large hole for passing a water pipe, a gas pipe or a pipe for an air conditioner to a wall, a floor, a foundation or the like constituted by concrete, a stone material or the like in constructing or adding or reforming a building. A core drill is attached with drilling blades formed by sintering diamond abrasive grains by a metal bond at a lower end edge of a core main body formed in a cylindrical shape circumferentially at intervals and by pressing the drilling blades to a concrete face and rotating the core main body, a groove in a shape of a circular ring is cut to form at concrete or the like and by cutting the groove gradually deeply, a hole penetrating concrete or the like is bored. The core drills are used in tools of a wet type cutting the hole by supplying a fluid for cooling to the drilling blades and a dry type which does not supply the cooling fluid.

In drilling operation by the core drill, when the drilling blades formed at a front end thereof cut concrete, a stone material or the like, a large amount of chips of concrete or the like is produced. When the chips are clogged between the core main body and an inner wall face of the bored hole, a resistance against rotating the core drill is increased to thereby reduce a drilling efficiency. Although when the core drill is used in the wet-type tool, the chips are evacuated comparatively efficiently by operation of making the cooling fluid flow, in operation by the dry type tool, the chips may not be evacuated sufficiently to thereby prolong an operational time period of boring.

Therefore, according to a core drill of a background art, an outer peripheral face of a core main body is formed with a chip evacuating groove in a spiral shape and chips produced by drilling blades at a front end thereof are evacuated to an upper side of the core main body via the groove by rotating the core drill (refer to, for example, JP-B-06-092083). Further, there is known a core drill improving evacuation of chips by forming an abrasive grain layer at a surface of a projected streak portion formed at an outer peripheral face of a core main body formed with a groove for evacuating chips and further finely grinding chips produced at drilling blades at a front end thereof by the abrasive grain layer (refer to, for example, JP-A-2000-309013)

According to the core drill of the background art, the chip evacuating groove for evacuating chips is formed in the spiral shape at the outer peripheral face of the core main body and therefore, there poses a problem that production cost is increased by requiring a number of steps in working by, for example, a lathe in producing the core main body. Further, according to the core drill of the background art, the groove for evacuating chips is formed by the same sectional area from a front end side to an upper end of the core drill and therefore, there poses a problem that operation of evacuating chips is not sufficiently carried out, chips formed at the front end portion is compressed to clog at inside of the groove, and the chips are brought into close contact with a wall face of the cut hole of concrete to thereby hamper the drilling efficiency.

Further, according to a hand-held tool for carrying out drilling operation by grabbing the tool by the hand, the outer peripheral face of the core main body is brought into contact with an inner wall face of a concrete hole in a wide area by swinging an axis line of the core drill and therefore, there also poses a problem that a drilling function is reduced by reducing a rotational speed of the core drill by increasing a friction resistance. In order to rotate the core drill at high speed against the friction resistance, a large-sized tool having a larger driving force needs to use.

DISCLOSURE OF THE INVENTION

It is a problem of the invention to resolve the above-described problem of the background arts and provide a core drill facilitating production and capable of reducing cost. Further, other problem of the invention is to provide a core drill capable of evacuating chips produced by a drilling blade efficiently to an upper side even when a dry type tool a is used and capable of promoting a drilling function by reducing a friction resistance between the core drill and an inner peripheral face of a concrete hole.

In order to resolve the former problem, the invention is characterized in a core drill including a shank connected to a rotating tool at an upper end thereof and constituted by a core main body in a cylindrical shape provided with a drilling blade at a lower end edge thereof, wherein a plurality of streaks of chip evacuating grooves in parallel with a rotational axis of a core main body are formed at an outer peripheral face of the core main body at intervals in a peripheral direction from a lower end portion to an upper end portion of the core main body in the cylindrical shape.

Further, the core drill according to the invention is characterized in that the chip evacuating groove is formed such that a sectional area thereof is gradually increased from the lower end portion to the upper end portion.

Further, the core drill according to the invention is characterized in that an opening for communicating inside and outside of the core main body is formed at a bottom of the chip evacuating groove.

Further, in order to achieve the latter problem, the invention is characterized in a core drill including a shank connected to a rotating tool at an upper end thereof, constituted by a core main body in a cylindrical shape provided with a drilling blade at a lower end edge thereof and formed with a chip evacuating groove at an outer peripheral face of the core main body from a lower end portion to an upper end portion of the core main body in the cylindrical shape, wherein a sectional area of the chip evacuating groove is formed to gradually increase from a lower end to an upper end of the core main body.

Further, the core drill according to the invention is characterized in that the chip evacuating groove is formed in a spiral shape at the outer peripheral face of the core main body.

Further, the core drill according to the invention is characterized in that an opening for communicating inside and outside of the core main body is formed at a bottom of the chip evacuating groove.

Further, the core drill according to the invention is characterized in that a slender groove is formed at the outer peripheral face of the core main body between contiguous ones of the chip evacuating grooves and from the lower end portion to the upper end portion of the core main body.

Further, the core drill according to the invention is characterized in that a lateral groove is formed at the outer peripheral face of the core main body between contiguous ones of the chip evacuating grooves and in a circumferential direction of the core main body.

Further, a core drill according to the invention is characterized in a core drill including a shank connected to a rotating tool at an upper end thereof and constituted by a core main body in a cylindrical shape provided with a drilling blade at a lower end edge thereof, wherein a plurality of streaks of chip evacuating grooves extended from a lower end portion to an upper end portion of the core main body in the cylindrical shape are formed at an outer peripheral face of the core main body along a circumferential direction and a number of projections projected from the outer peripheral face of the core main body in a radial direction are formed at the outer peripheral face of the core in the cylindrical shape between contiguous ones of the chip evacuating grooves.

Figure 1:
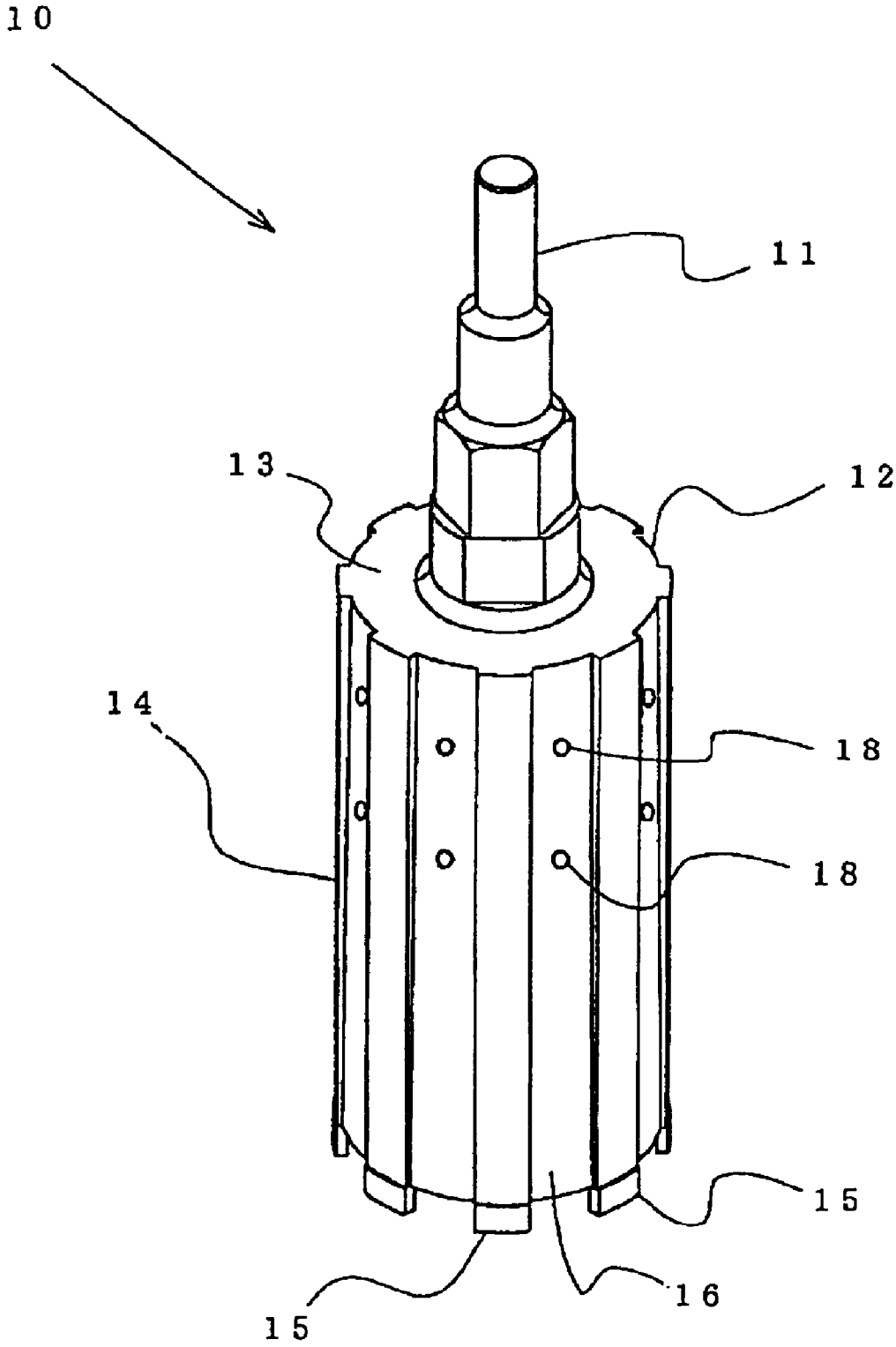
FIG. 1 is a perspective view of a core drill according to an embodiment of the invention.

Further, in notations in the drawings, numeral 10 designates a core drill, numeral 11 designates a shank, numeral 12 designates a drill main body, numeral 13 designates an upper end portion, numeral 14 designates a core main body, numeral 15 designates a drilling blade, numeral 16 designates a chip evacuating groove, numeral 17 designates a groove bottom portion, numeral 18 designates an opening, numeral 20 designates a core drill, numeral 26 designates a chip evacuating groove, numeral 30 designates a core drill, numeral 36 designates a chip evacuating groove, numeral 40 designates a core drill, notation 46*a* designates a chip evacuating groove, notation 46*b* designates a chip evacuating groove, numerals 50, 60 designate core drills, numerals 51, 61 designate chip evacuating grooves, numerals 52, 62, 70, 72 designate projections, and numeral 53, 63, 71,73 designate top portions.

BEST MODE FOR CARRYING OUT THE INVENTION

An explanation will be given of a mode for carrying out the invention based on embodiments shown in the drawings as follows. FIG. 1 shows the core drill 10 according to a first embodiment of the invention which is constituted by the shank 11 coupled to a rotating tool and transmitted with a rotating force similar to the background art, and the drill main body 12 coupled to a lower end portion of the shank 11. The drill main body 12 is constituted by the core main body 14 in a cylindrical shape the upper end portion 13 of which is closed, and a plurality of drilling blades 15 attached to a lower end edge of the core main body 14 at intervals in a circumferential direction. The drilling blade 15 is molded in a tip-like shape by sintering a metal bond mixed with diamond abrasive grains and the drilling blades 15 are bonded to the lower end edge of the core main body 14 by welding at equal intervals in a peripheral direction.

A plurality of the chip evacuating grooves 16 extended in a vertical direction in parallel with a rotational axis of the core drill are formed at an outer peripheral face of the core main body 14 at predetermined intervals in the peripheral direction. By forming the chip evacuating groove 16 in parallel with the shaft of the core main body 14 in this way, in comparison with the groove in the spiral shape of the background art, working by a lathe or the like is not needed, fabricating steps are simplified and fabrication cost or the like can be reduced.

Figure 2:
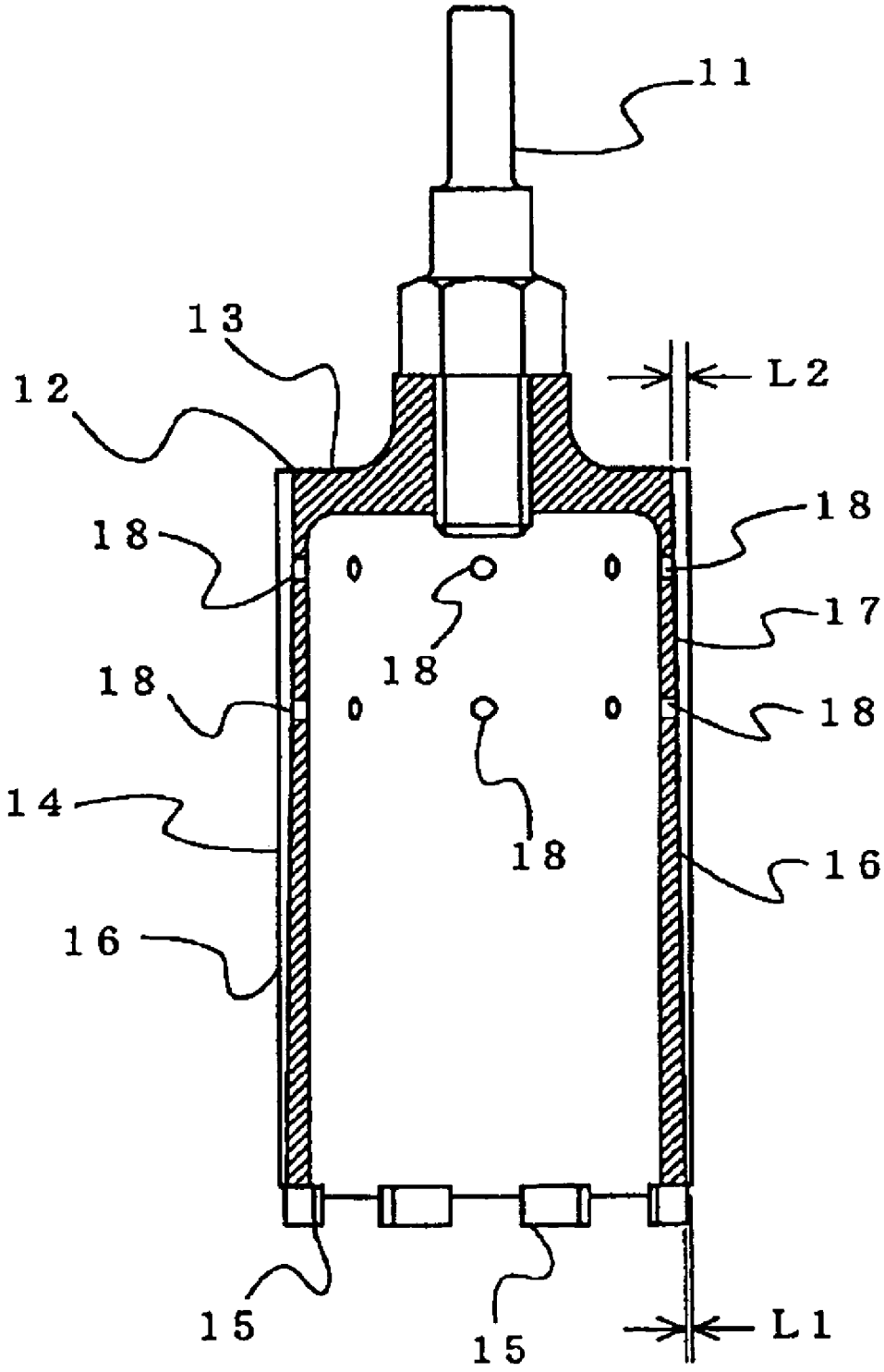
FIG. 2 is a vertical sectional view of a core drill the same as that in FIG. 1.

Further, according to the embodiment, as shown by FIG. 2, the chip evacuating groove 16 is cut to gradually change a depth thereof such that a depth L2 of the chip evacuating groove at the upper end portion 13 is larger than a depth L1 of the chip evacuating groove at the lower end portion proximate to the drilling blades 15 to thereby form the chip evacuating groove 16 such that a sectional area thereof is increased to an upper side. Therefore, in pushing up chips at inside of the chip evacuating groove 16 to the upper side by chips produced by the drilling blades 15 at the lower end portion of the core main body 14, chips are prevented from being clogged at inside of the chip evacuating groove 16 at the widened upper portion.

Further, the groove bottom portion 17 of the chip evacuating groove 16 is formed with the opening 18 for communicating inside and outside of the cylinder of the core main body 14 and air compressed on an inner side of the core main body 14 by progressing drilling by the core drill 10 is exhausted to an outer side of the core main body 14. At this occasion, compressed air to be exhausted is exhausted into the chip evacuating groove 16 and therefore, compressed air is not hampered from being exhausted and operation of evacuating chips at inside of the chip evacuating groove 16 to the upper side is promoted by a flow of compressed air to be exhausted.

Figure 3:
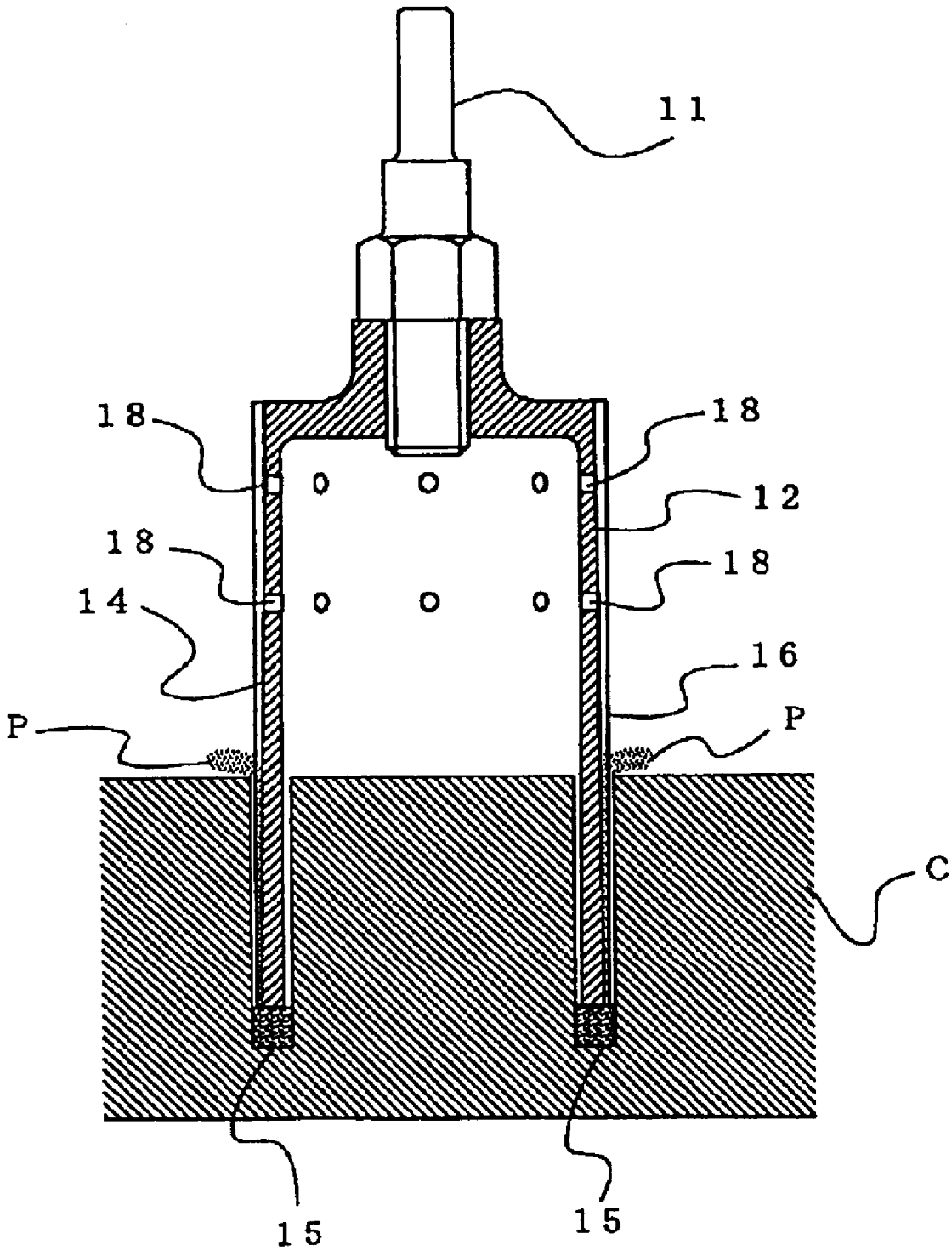
FIG. 3 is a sectional view showing a state of drilling concrete by the core drill of the embodiment of FIG. 1.

FIG. 3 shows a state in the midst of drilling operation by the core drill 10 in the above-described embodiment. By rotating the core drill 10, a surface of concrete C is cut by the drilling blades 15 to thereby form a groove in a ring-like shape. Further, at an initial stage of the drilling operation, a rotational center of the drilling blades 15 is positioned by mounting a center pin at a center of the core drill 10. Chips P produced by cutting by the drilling blades 15 are moved into the chip evacuating groove 16, pushed up to the upper side gradually by the chips P successively produced by the drilling blades 15 and evacuated to the surface of the concrete. Although air on the inner side of the core main body 14 is compressed in accordance with progress of drilling, air is exhausted to the outer side of the core main body 14 via the opening 18 and the drilling efficiency is not hampered by compressed air. Further, when drilling is further progressed and the core main body 14 is immerged in the concrete C to a portion of the opening 18, by the flow of exhausting compressed air, chips at inside of the chip evacuating groove 16 are helped to evacuate to the upper side and therefore, chips are evacuated excellently. Further, concrete powder dust remaining at a space on the inner side of the core main body 14 is exhausted to outside from the opening 18 and therefore, a resistance against rotation which is brought about by storing the powder dust at the inner side space is nullified, loss in rotating the core main body 14 is reduced and drilling can be carried out efficiently.

Figure 4:
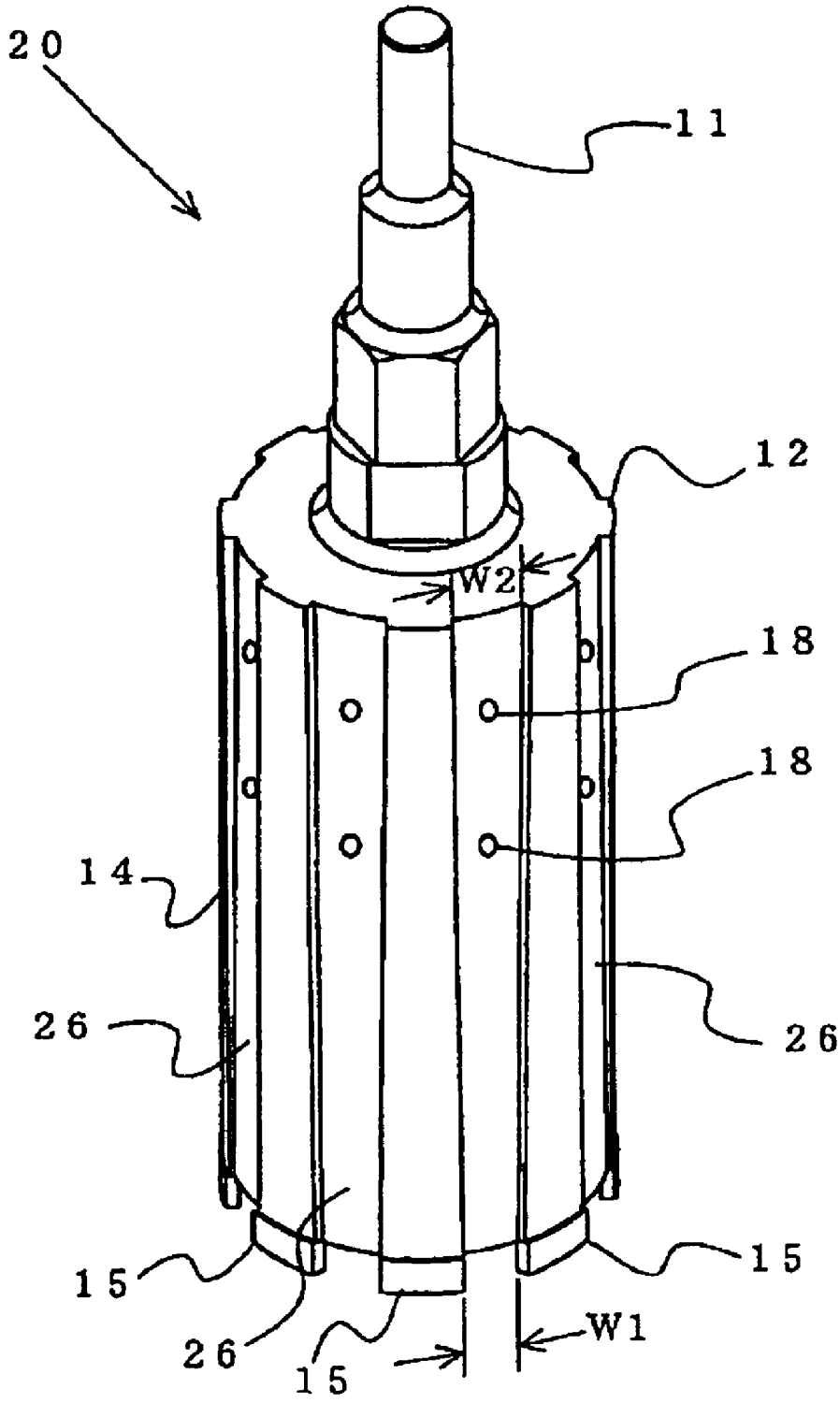
FIG. 4 is a perspective view of a core drill according to other embodiment of the invention.

FIG. 4 shows the core drill 20 according to other embodiment of the invention and although the embodiment is the same as the above-described embodiment in that the outer peripheral face of the core main body 14 is formed with a plurality of the chip evacuating grooves 26 in parallel with a rotational axis line of the core drill 20, the chip evacuating groove 26 of the embodiment is cut to form such that a depth of the groove is formed to be the same from a lower end to an upper end thereof and a groove width of the chip evacuating groove is gradually increased such that a groove width W2 at an upper end portion thereof is wider than a groove width W1 at a lower end portion of the core main body 14 to thereby form the chip evacuating groove such that a sectional area of the chip evacuating groove 26 is gradually increased from the lower end to the upper end. Therefore, chips produced by the drilling blades 15 are pushed up to the upper side of the chip evacuating groove 26 having a large sectional area and therefore, chips are not clogged at inside of the chip evacuating groove 26 and evacuation is carried out excellently.

Figure 5:
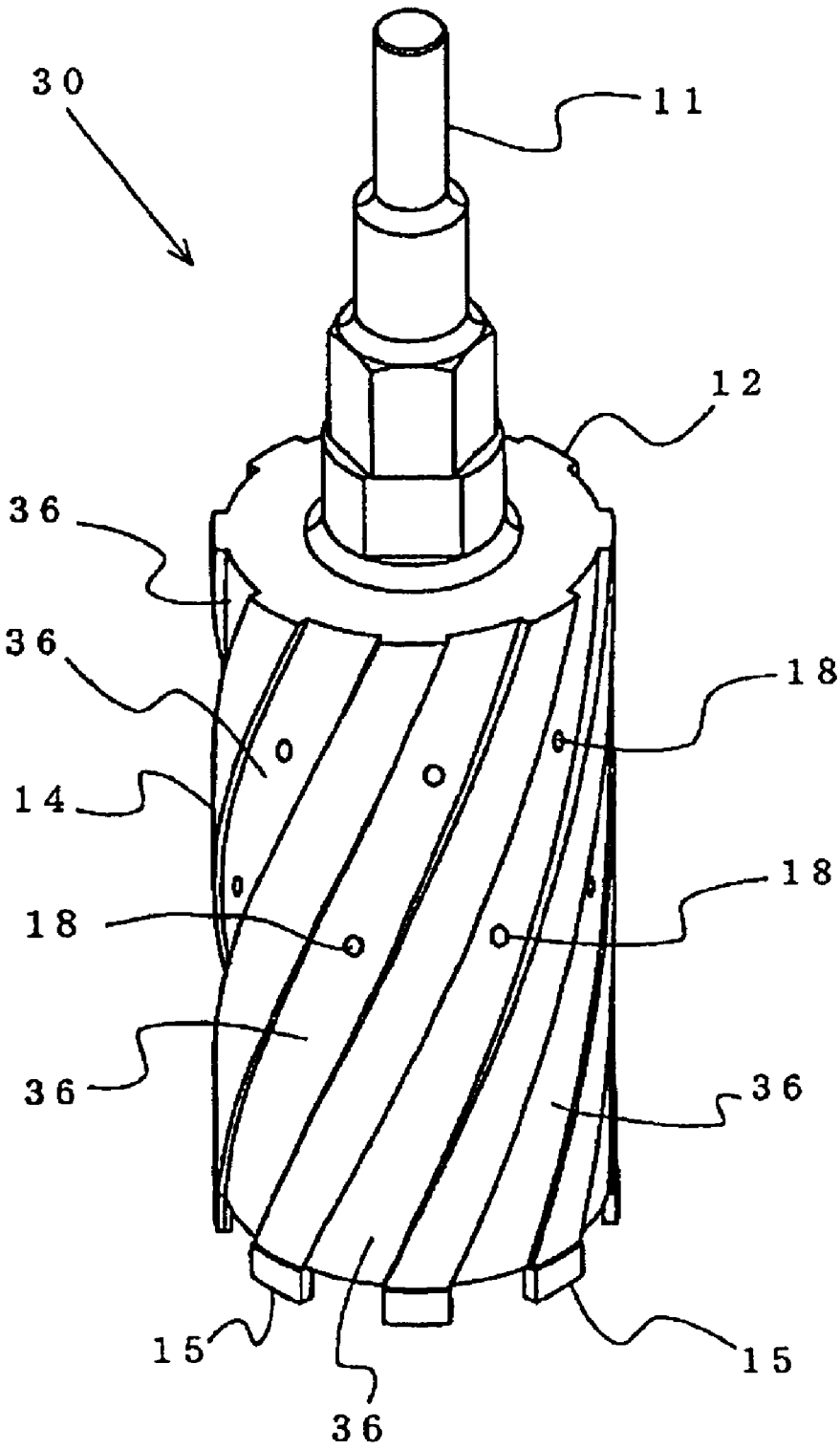
FIG. 5 is a perspective view of a core drill according to other embodiment of the invention.

FIG. 5 shows the core drill 30 according to still other embodiment of the invention which is formed such that the chip evacuating groove 36 formed at the outer peripheral face of the core main body 14 is formed such that a sectional area thereof is gradually increased from a lower end side to an upper end thereof to thereby prevent chips from being clogged at inside of the chip evacuating groove 36. According to the embodiment, the chip evacuating groove 36 is formed by cutting in a spiral shape along the outer peripheral face of the core main body 14 such that a depth of the chip evacuating groove 36 is gradually deepened from a lower end to an upper end thereof. According to the chip evacuating groove 36 of the embodiment, different from the chip evacuating groove in the spiral shape according to the background art, a plurality of streaks of the chip evacuating grooves 36 in the spiral shape increasing the spiral pitch are arranged in the circumferential direction at equal intervals along the outer peripheral face of the core main body 14 to thereby facilitate to evacuate chips produced by the drilling blades 15 to the upper side.

Figure 6:
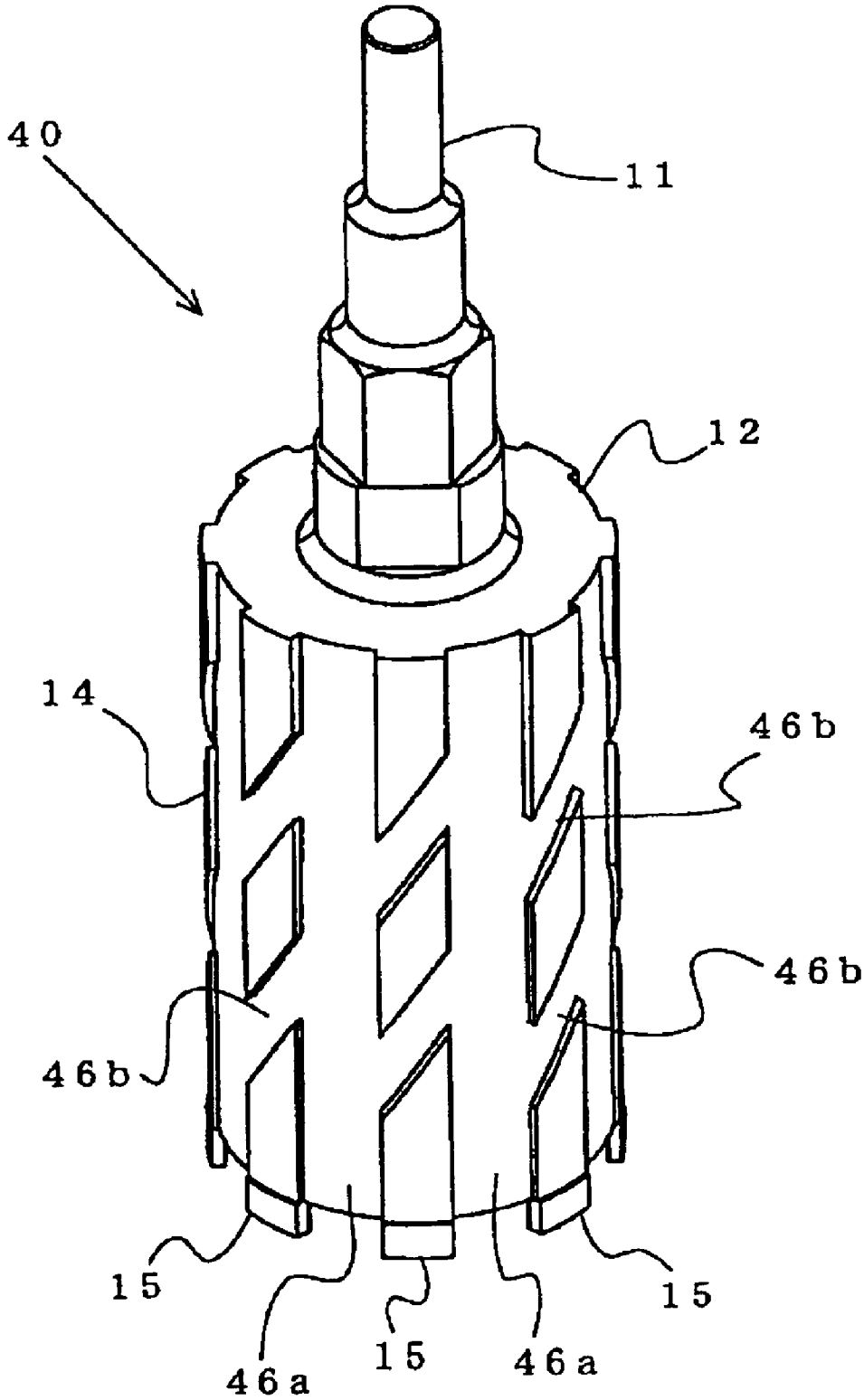
FIG. 6 is a perspective view of a core drill according to still other embodiment.

FIG. 6 shows the core drill 40 according to still other embodiment, similar to the above-described embodiment shown in FIG. 1, the chip evacuating grooves 46*a* in the vertical direction in parallel with the rotational axis line are formed at the outer peripheral face of the core main body 14 at equal intervals in the peripheral direction and a plurality of streaks of the chip evacuating grooves 46*b* in the spiral shape similar to those of the embodiment shown in FIG. 5 are formed to intersect with the chip evacuating grooves 46*a* in the vertical direction. By forming the chip evacuating grooves 46*a*, 46*b* in this way, evacuation of chips to the upper side is further improved by operation of rotating the portion of the core main body 14.

In any of the above-described embodiments, by forming diamond abrasive grain layers on an outer surface of the core main body 14 formed to arrange among the chip evacuating grooves 16, 26, 36, 46*a*, 46*b*, bringing the abrasive grain layers into contact with chips produced by the drilling blades 15 to further finely polish chips to further make evacuation of chips effective and bringing the diamond abrasive grain layers into contact with an object to be cut of concrete or the like, the resistance against rotation can be reduced and further excellent cutting operation can be carried out.

Figure 7:
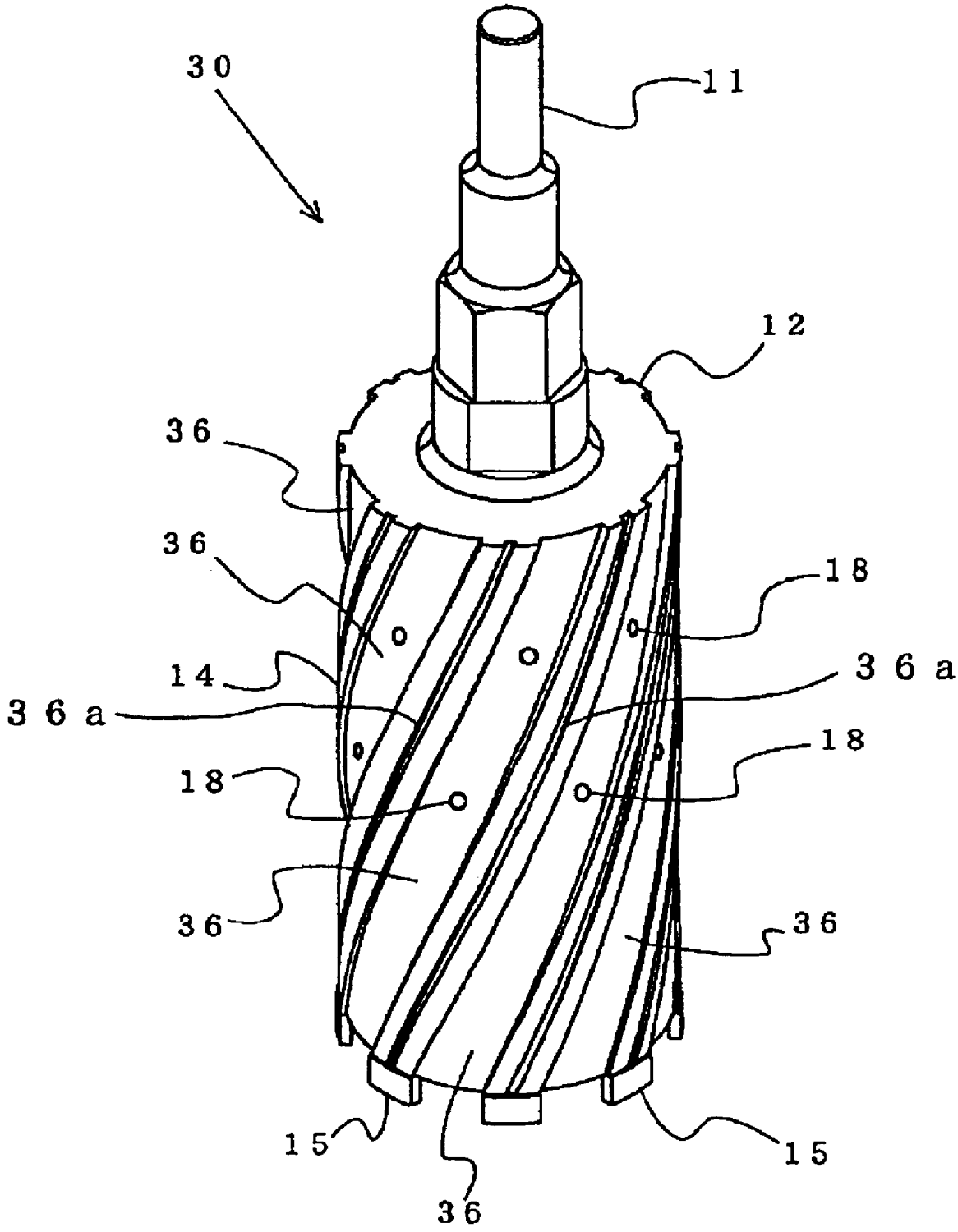
FIG. 7 is a perspective view of an example of forming a slender groove at an outer peripheral face between chip evacuating grooves.

FIG. 7 shows an example of forming a slender groove 36*a* from the lower end portion to the upper end portion of the core main body 14 on the outer peripheral face between the contiguous chip evacuating grooves 36. A plurality of the slender groove 36*a* may be provided. According thereto, a contact area between the outer peripheral face of the core main body 14 and concrete is reduced and therefore, the resistance against rotation is reduced, the rotational speed can be maintained and the high drilling function can be ensured.

Further, the similar slender groove 36*a* can be formed at the outer peripheral face between the contiguous chip evacuating grooves 16 or 26 also in the examples of FIG. 1 and FIG. 4.

Figure 8:
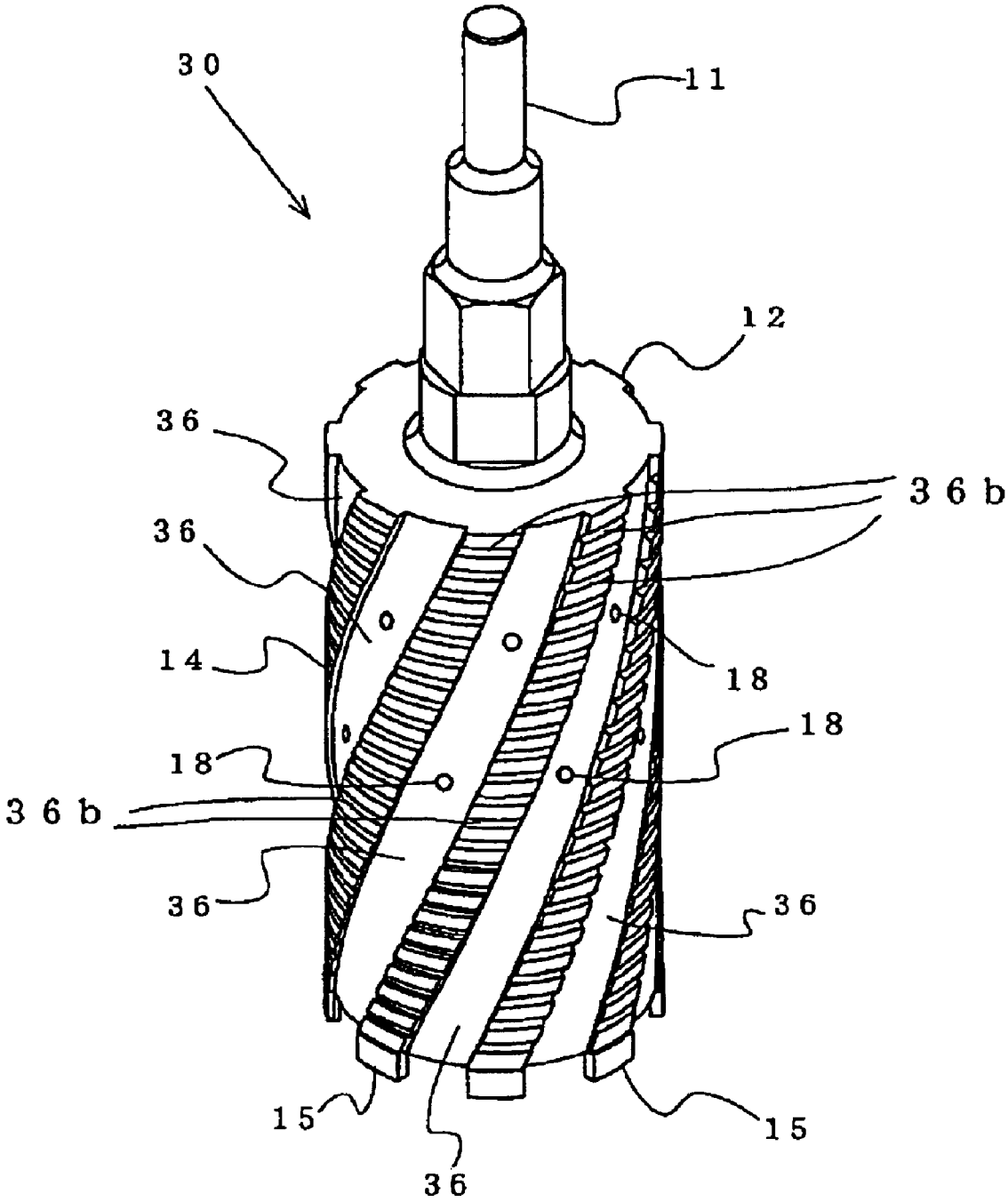
FIG. 8 is a perspective view of an example of forming a lateral groove at an outer peripheral face between chip evacuating grooves.

Further, FIG. 8 shows an example of forming a lateral groove 36*b* in the circumferential direction of the core main body 14 to the outer peripheral face between the contiguous chip evacuating grooves 36. The lateral groove 36*b* is formed along the rotational direction, the contact area between the outer peripheral face of the core main body 14 and concrete is reduced and therefore, also in this case, the resistance against rotation is reduced, the rotational speed can be maintained and the high drilling function can be ensured.

Further, the similar lateral groove 36*b* can be formed at the outer peripheral face between the contiguous chip evacuating grooves 16 or 26 also in examples of FIG. 1 and FIG. 4.

Figure 9:
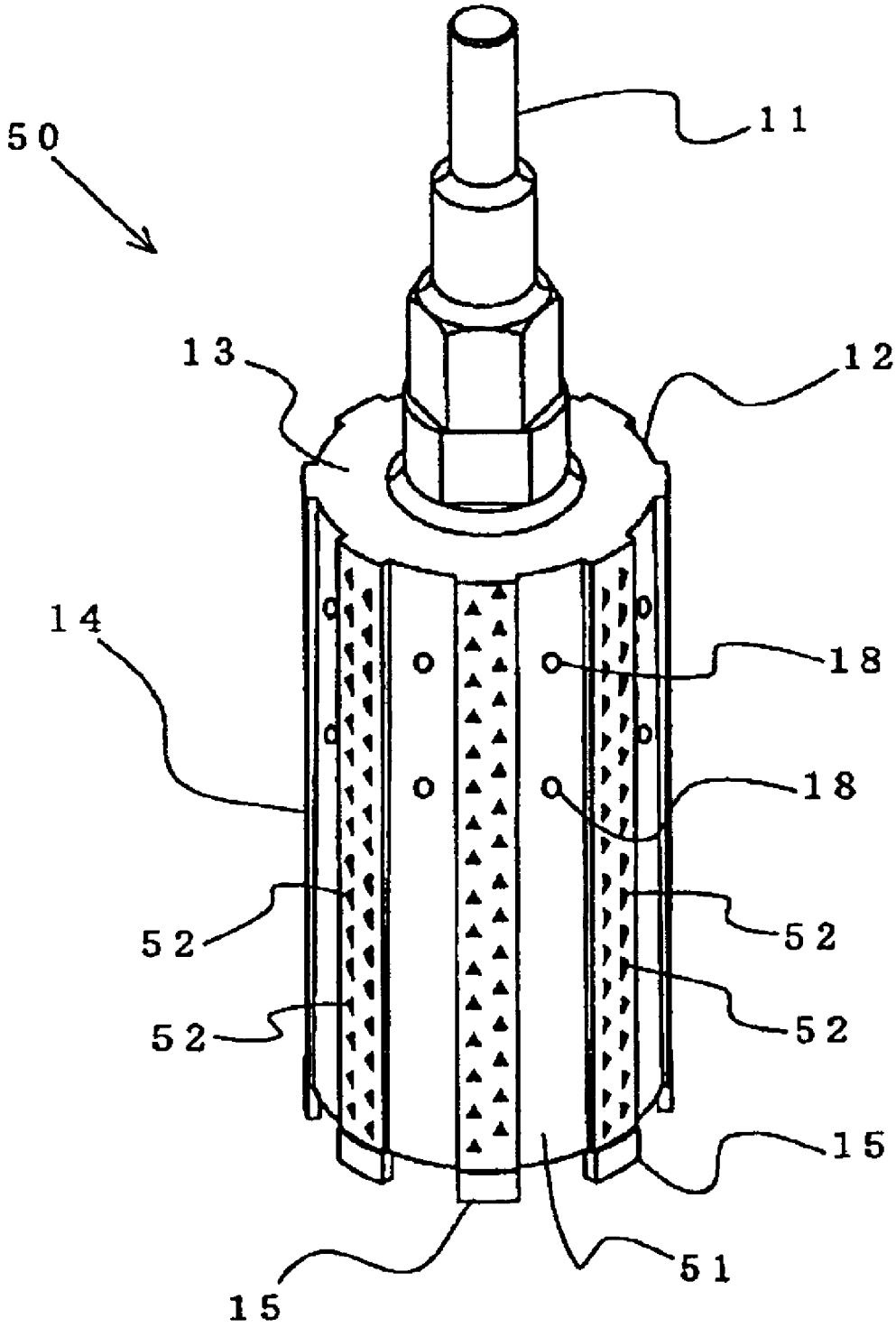
FIG. 9 is a perspective view of a core drill according to other embodiment of the invention.

Next, still other embodiment of the invention will be explained. As shown by FIG. 9, similar to the above-described embodiment, the core drill 50 according to the embodiment is constituted by the shank 11 coupled to a rotating tool, and the drill main body 12 attached to the lower end portion of the shank 11 and the drill main body 12 is constituted by the core main body 14 in the cylindrical shape the upper end portion 13 of which is closed and the drilling blade 15 attached to the lower end edge of the core main body 14. The outer peripheral face of the core main body 14 is formed with a plurality of the chip evacuating grooves 51 extended in the vertical direction in parallel with the rotational axis of the core drill 50 at predetermined intervals in the peripheral direction. Further, the chip evacuating groove 51 is cut such that the depth of the upper end portion 13 becomes gradually larger than that of the lower end portion proximate to the drilling blades 15 and formed such that a sectional area of the chip evacuating grooves 51 is gradually increased to the upper side. Thereby, chips produced by the drilling blades 15 are prevented from being clogged at inside of the chip evacuating groove 51. A bottom of the chip evacuating groove 51 is formed with the opening 18 for communicating inside and outside of the cylinder of the core main body 14. Also the effect by the opening 18 is as described above.

Figure 10A:
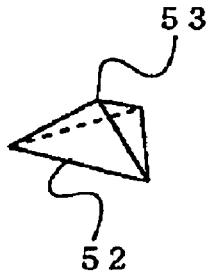
FIGS. 10(*a*), 10(*b*) and 10(*c*) show details of a projection of the core drill of FIG. 9, FIG. 10(*a*) is a perspective view, FIG. 10(*b*) is a front view and FIG. 10(*c*) is a sectional view.
Figure 10B:
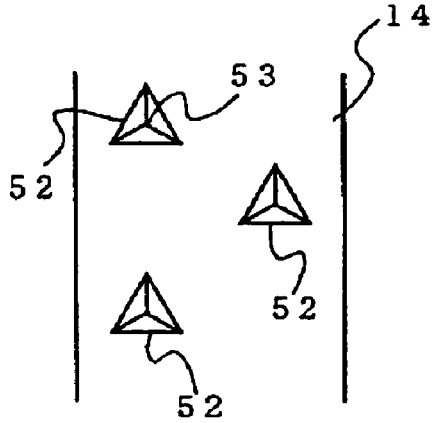
Figure 10C:
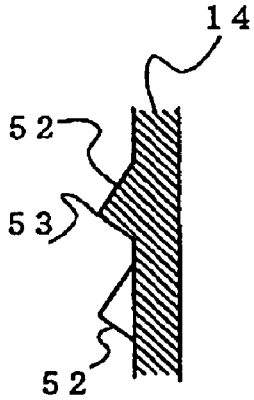

Further, a number of the projections 52 are formed at the outer peripheral face of the core main body 14 between the contiguous chip evacuating grooves 51 of the core main body 14 of the core drill 50 according to the embodiment from the lower end portion to the upper end portion of the core main body 14. As shown by FIGS. 10(*a*), 10(*b*) and 10(*c*), the projection 52 is formed in a shape of a triangular pyramid and the top portion 53 is projected in a radial direction of the core main body 14 and the top portion 53 of the projection 52 is brought into contact with an inner peripheral face of a concrete hole bored by the drilling blades 15. The projection 52 can be formed at the outer peripheral face of the core main body 14 by means of welding or the like. By bringing the top portion 53 of the projection 52 into contact with the inner peripheral face of the concrete hole bored by the drilling blade 15, a total of the outer peripheral face of the core main body 14 is not brought into contact with the inner peripheral face of the concrete hole. Therefore, the friction resistance in rotating the core drill 50 is reduced and the rotational speed of the core drill can be prevented from being reduced.

Figure 11:
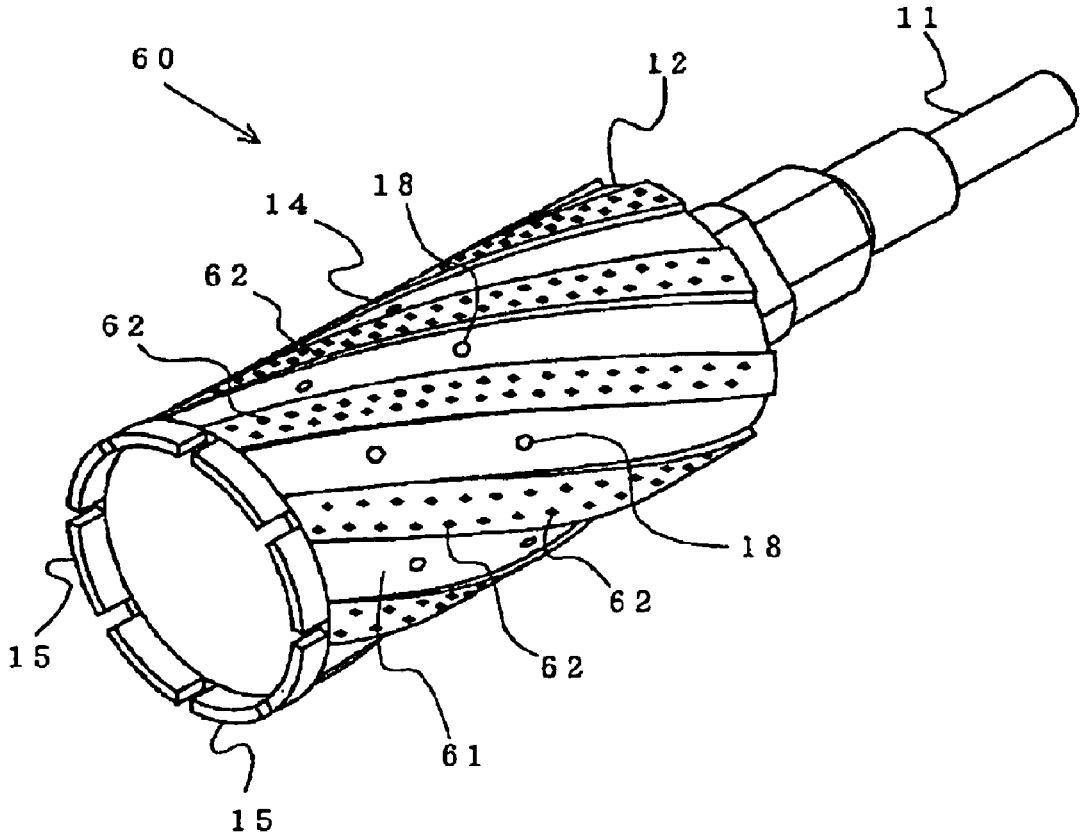
FIG. 11 is a perspective view of a core drill according to still other embodiment of the invention.

FIG. 11 shows the core drill 60 according to still other embodiment and according to the embodiment, a plurality of streaks of the chip evacuating grooves 61 in the spiral shape are formed at the outer peripheral face of the core main body 14 along the outer peripheral face of the core main body 14 at equal intervals in the circumferential direction and the chip evacuating grooves 61 are formed such that a sectional area of the chip evacuating groove 61 is gradually increased from a lower end side to an upper end thereof to thereby prevent chips from being clogged at inside of the chip evacuating groove 61.

Figure 12A:
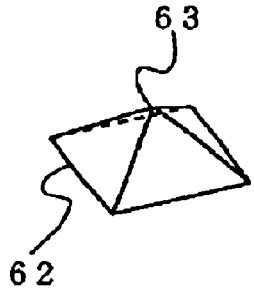
FIGS. 12(*a*), 12(*b*) and 12(*c*) show details of a projection of the core drill of FIG. (11), FIG. 12(*a*) is a perspective view, FIG. 12(*b*) is a front view and FIG. 12(*c*) is a sectional view.
Figure 12B:
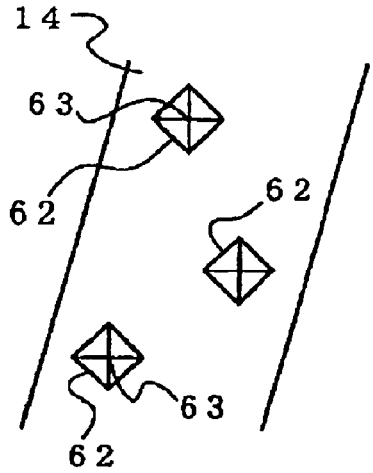
Figure 12C:
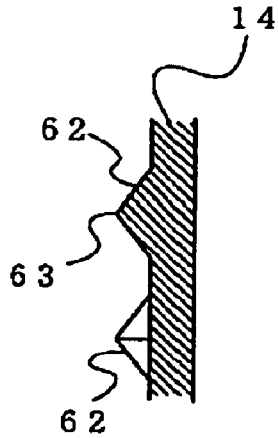

A number of the projections 62 are formed at the outer peripheral face of the core main body 14 between the contiguous chip evacuating grooves 61 of the core drill 60 from the lower end portion to the upper end portion of the core main body 14. As shown by FIGS. 12(*a*), 12(*b*) and FIG.(*c*), the projection 62 is formed in a shape of a pyramid a bottom face of which is formed in a rectangular shape or a rhombic shape and formed to project the top portion 63 of the projection 62 from the outer peripheral face of the core main body 14 in the radial direction. By bringing the top portion 63 of the projection 62 into contact with the inner peripheral face of the concrete hole bored by the drilling blades 15, a total of the outer peripheral face of the core main body 14 is not brought into contact with the inner peripheral face of the concrete hole to thereby reduce the friction resistance in rotating the core drill 60.

Figure 13A:
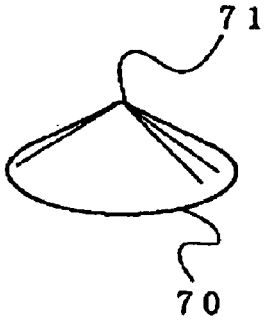
FIGS. 13(*a*), 13(*b*) and 13(*c*) show other embodiment of a projection, FIG. 13(*a*) is a perspective view, FIG. 13(*b*) is a front view and FIG. 13(*c*) is a sectional view.
Figure 13B:
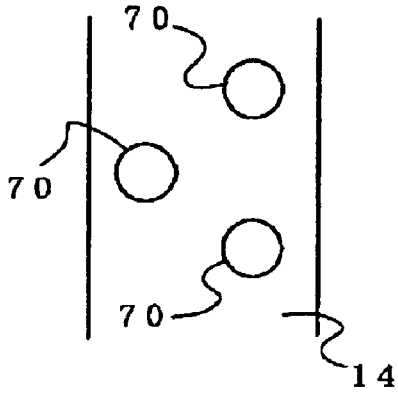
Figure 13C:
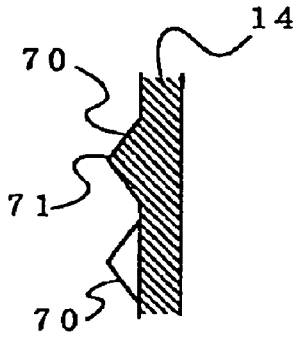
Figure 14A:
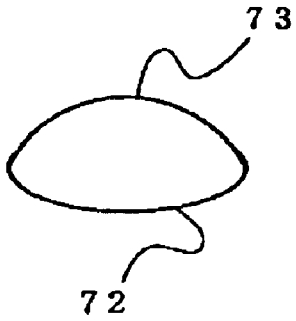
FIGS. 14(*a*), 14(*b*) and 14(*c*) show still other embodiment of a projection, FIG. 14(*a*) is a perspective view, FIG. 14(*b*) is a front view and FIG. 14(*c*) is a sectional view.
Figure 14B:
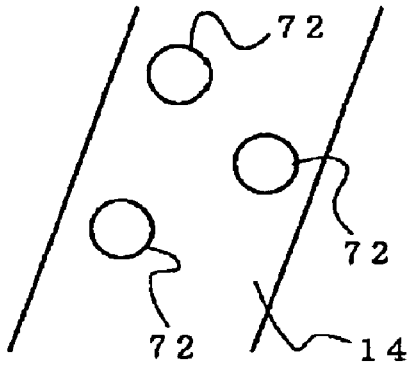
Figure 14C:
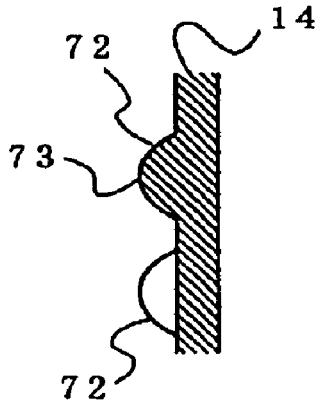

Although in the above-described embodiments, an explanation has been given by the embodiments in which the chip evacuating grooves 51, 61 formed at the outer peripheral face of the core main body 14 are formed in parallel with the center axis line of the core drill or in the spiral shape, the shape and the structure of the chip evacuating groove may be constituted by any of the embodiments, further, a groove in the vertical direction and a groove in the spiral shape may be integrated to form as in the embodiment shown in, for example, FIG. 6. Further, the shape of the projection is not limited to the shape of the triangular pyramid and the shape of the pyramid but as shown by FIGS. 13(*a*), 13(*b*) and 13(*c*), the shape may be formed by the projection 70 in a shape of a circular cone projecting the top portion 71 thereof in the radial direction, or, as shown by FIGS. 14(*a*), 14(*b*) and 14(*c*), the shape may be formed by the projection 72 in a semispherical shape bulging the top portion 73 in a spherical shape in the radial direction. Further, two or more of shapes in the shape of the triangular pyramid, the shape of the pyramid, the shape of the circular cone and the semispherical shape may be combined.

Further, the invention is not limited to the above-described embodiments but can variously be modified within the technical range of the invention and the invention naturally covers the modifications.

The application is based on Japanese Patent Application Japanese Patent Application No. 2002-010740) filed on Jan. 18, 2002, Japanese Patent Application (Japanese Patent Application No. 2002-306664) filed on Oct. 22, 2002 and Japanese Patent Application (Japanese Patent Application No. 2003-003646) filed on Jan. 9, 2003 and contents thereof are incorporated here by reference.

INDUSTRIAL APPLICABILITY

According to the core drill of the invention, by forming the chip evacuating groove in parallel with the shaft of the core main body, in comparison with the groove formed in the spiral shape of the background art, fabricating steps are simplified and fabrication cost or the like can be reduced.

Further, by forming the core drill according to the invention such that the sectional area of the chip evacuating groove is gradually increased from the lower end to the upper end, in pushing up chips at inside of the chip evacuating groove to the upper side by chips produced by the drilling blades, chips are pushed up in a direction of widening the sectional area of the groove and therefore, chips are not clogged at inside of the chip evacuating groove, chips are evacuated excellently and chips can be prevented from constituting the resistance against rotation of the core drill. Therefore, the drilling efficiency can be promoted.

Further, according to the core drill of the invention, by forming the opening for communicating inside and outside of the core main body at the bottom of the chip evacuating groove, the concrete powder dust remaining at the inner side space of the core main body 14 is evacuated to outside from the opening 18 and therefore, the resistance against rotation produced by storing the powder dust in the inner side space is eliminated, loss in rotating the core main body 14 is reduced and drilling can be carried out efficiently.

Further, by forming the chip evacuating groove in the spiral shape at the outer peripheral face of the core main body, chips produced in drilling can be facilitated to evacuate to the upper side.

Further, by forming the slender groove or the lateral groove at the outer peripheral face between the contiguous chip evacuating grooves in the core drill according to the invention, the contact area between the outer peripheral face of the core main body 14 and concrete is reduced and therefore, the resistance against rotation is reduced, the rotational speed can be maintained and the high drilling function can be ensured.

Further, in the core drill of the invention, by forming a number of the projections projected from the outer peripheral face of the core main body in the radial direction at the outer peripheral face of the core main body between the chip evacuating grooves formed at the core main body, the top portions of the projections projected in the radial direction are brought into contact with the inner peripheral face of the concrete hole bored by the drilling blades, the friction resistance by bringing the total face of the core main body into contact with the inner peripheral face of the concrete hole can be prevented from being increased and the drilling function by reducing the rotational speed of the core drill can be prevented from being reduced.

What is claimed is:

1. A core drill comprising:

a shank connected to a rotating tool at an upper end thereof;

a core main body in a cylindrical shape attached to a lower end of the shank;

a drilling blade provided at a lower end edge of the core main body; and a plurality of chip evacuating grooves formed from a lower end portion to an upper end portion of an outer peripheral face of the core main body and formed in parallel with a rotational axis of the core main body and at intervals in a peripheral direction, wherein the chip evacuating groove is formed such that a sectional area thereof is gradually increased from the lower end portion to the upper end portion of the outer peripheral face of the core main body.

2. The core drill according to claim 1, further comprising:

a spiral chip evacuating groove formed in a spiral shape at the outer peripheral face of the core main body.

3. The core drill according to claim 1, wherein an opening for communicating inside and outside of the core main body is formed at a bottom of the chip evacuating groove.

4. A core drill comprising:

a shank connected to a rotating tool at an upper end thereof;

a core main body in a cylindrical shape attached to a lower end of the shank;

a drilling blade provided at a lower end edge of the core main body; and a plurality of chip evacuating grooves formed from a lower end portion to an upper end portion of an outer peripheral face of the core main body and formed at intervals in a peripheral direction;

wherein the chip evacuating groove is formed such that a sectional area of the chip evacuating groove is gradually increased from the lower end portion to the upper end portion of the outer peripheral face of the core main body.

5. The core drill according to claim 4, wherein the chip evacuating groove is formed in a spiral shape at the outer peripheral face of the core main body.

6. The core drill according to claim 4, wherein an opening for communicating inside and outside of the core main body is formed at a bottom of the chip evacuating groove.

7. The core drill according to claim 4, further comprising:

a slender groove formed at the outer peripheral face of the core main body between contiguous ones of the chip evacuating grooves and from the lower end portion to the upper end portion of the core main body.

8. The core drill according to claim 4, further comprising:

a lateral groove formed at the outer peripheral face of the core main body between contiguous ones of the chip evacuating grooves and in a circumferential direction of the core main body.

9. The core drill according to claim 4, wherein a depth of the chip evacuating groove proximate the upper end portion of the core main body is greater than a depth of the chip evacuating groove proximate the lower end portion of the core main body.

10. The core drill according to claim 9, wherein a width of the chip evacuating groove proximate the upper end portion of the core main body is greater than a width of the chip evacuating groove proximate the lower end portion of the core main body.

11. The core drill according to claim 4, wherein a width of the chip evacuating groove proximate the upper end portion of the core main body is greater than a width of the chip evacuating groove proximate the lower end portion of the core main body.

12. A core drill comprising:

a shank connected to a rotating tool at an upper end thereof;

a core main body in a cylindrical shape attached to a lower end of the shank;

a drilling blade provided at a lower end edge of the core main body;

a plurality of chip evacuating grooves formed from a lower end portion to an upper end portion of an outer peripheral face of the core main body and formed at intervals in a peripheral direction; and a plurality of projections projected at the outer peripheral face of the core main body between contiguous ones of the chip evacuating grooves and in a radial direction from the outer peripheral face of the core main body, wherein the projection comprises at least one of a shape of a triangular pyramid, a shape of a pyramid, a shape of a circular cone and a semispherical shape.

13. The core drill according to claim 12, wherein the chip evacuating groove is formed in parallel with a rotational axis of the core main body.

14. The core drill according to claim 12, wherein the chip evacuating groove is formed in a spiral shape at the outer peripheral face of the core main body.

15. The core drill according to claim 12, wherein the chip evacuating grooves are formed such that a sectional area thereof is gradually increased from the lower end portion to the upper end portion of the outer peripheral face of the core main body.

16. A core drill comprising:

a shank connected to a rotating tool at an upper end thereof;

a core main body in a cylindrical shape attached to a lower end of the shank;

a drilling blade provided at a lower end edge of the core main body;

a plurality of chip evacuating grooves formed from a lower end portion to an upper end portion of an outer peripheral face of the core main body and formed in parallel with a rotational axis of the core main body and at intervals in a peripheral direction; and a spiral chip evacuating groove formed in a spiral shape at the outer peripheral face of the core main body.

* * * * *